United States Patent [19]

Löfgren et al.

[11] Patent Number: 4,771,588

[45] Date of Patent: Sep. 20, 1988

[54] MACHINE FOR AUTOMATIC SEALING OF STERILE BOTTLES IN A BOTTLE FILLING PLANT

[75] Inventors: Peter Löfgren, Hovås; Nils Årthun, Partille, both of Sweden

[73] Assignee: Steridose Systems AB, Askim, Sweden

[21] Appl. No.: 74,678

[22] Filed: Jul. 17, 1987

[51] Int. Cl.[4] ..... B67B 1/08; B67B 3/14; B65B 7/28

[52] U.S. Cl. ..... 53/319; 53/353

[58] Field of Search ..... 53/351, 353, 367, 368, 53/348, 319, 354, 364, 365

[56] References Cited

U.S. PATENT DOCUMENTS

| | | | |
|---|---|---|---|
| 880,406 | 2/1908 | Schmitt | 53/351 |
| 1,021,825 | 4/1912 | Craggs | 53/354 |
| 1,212,665 | 1/1917 | Nordstrom | 53/354 X |
| 1,954,737 | 4/1934 | Kowal | 53/351 |
| 2,154,409 | 4/1939 | Podel | 53/351 X |
| 2,643,805 | 6/1953 | Strobel | 53/351 |
| 3,332,211 | 7/1967 | Koll et al. | 53/353 |
| 3,672,121 | 6/1972 | Kawaminani | 53/351 |
| 3,998,032 | 12/1976 | Koebbeman | 53/351 X |

*Primary Examiner*—Horace M. Culver

*Attorney, Agent, or Firm*—Wegner & Bretschneider

[57] ABSTRACT

A machine for automatic sealing of sterile bottles in a bottle filling plant is proved enabling high capacity. The machine has fluid powered means to axially displace a die forming means between a position above said bottle and a position surrounding a cap in the bottle mouth. Telescopically displaceable means are also provided to close said die forming means radially around the neck of said bottle and, after execution of said sealing, to open said die forming means radially. The machine also includes telescopically displaceable plunger means to apply axial pressure towards the top of the cap pressing it down into the die forming tool against the action of a resilient plug in the mouth of the bottle.

12 Claims, 5 Drawing Sheets

MACHINE FOR AUTOMATIC SEALING OF STERILE BOTTLES IN A BOTTLE FILLING PLANT

BACKGROUND OF THE INVENTION

This invention relates to machines for automatic sealing of sterile bottles in a bottle filling plant. More particularly, this invention relates to a bottle sealing machine for bottles having an annular bead at the mouth of said bottle and wherein said mouth of the bottle is sealed by a resilient plug and a metal cap and the filling plant comprise means to position said bottle below said machine.

Aseptic fluids like vaccine, anaesthetic drugs and other injectable fluids are produced and bottled under very stringent sterile conditions. The storability of these fluids is dependant upon the bottle seal. According to the state of the art, pressure is applied from above onto the cap resting in the bottle mouth, so that the bottle is pressed against a surface while said cap is pressed into the bottle mouth. At this moment a capsuling tool is applied to the cap, below the annular bead, which tool is rotated while pressing the skirt of the cap in below said bead. This rotatable tool is driven via a transmission by an electric motor. Normally the entire tool with motor and transmission must be raised or lowered if production is changed to a smaller or larger bottle size. At these moments, it is difficult to adjust this known machine so that exactly the right axial pressure is applied to the cap and bottle. If the pressure is not enough, the quality of the capsuling will be effected and if the pressure is too high, the bottle may break.

The primary object of the present invention is to provide an improved sealing machine that does not require precise adjustment to bottle size.

A further object of the invention is to provide a simple sealing machine without any rotating parts.

SUMMARY OF THE INVENTION

In accordance with the objects, this invention provides an automatic sealing machine comprising fluid powered means to axially displace a die forming means between a position above said bottle and a position surrounding said cap, telescopically displaceable means to close said die forming means radially around the neck of said bottle and, after execution of said sealing, to open said die forming means radially, and telescopically displaceable plunger means to apply axial pressure towards the top of said cap pressing it down into the die forming tool against the action of said resilient plug.

BRIEF DESCRIPTION OF THE DRAWINGS

The accompanying drawings illustrate an embodiment of the invention which will now be described, by way of an example.

Of the drawings:

Referring to FIG. 1 in the drawings, the machine comprises a stand 10 and a pneumatically operated cylinder 11. The cylinder 11 is mounted on a vertical shaft 12 on the stand 10, so that its height can be adjusted roughly via a control handle 13. The stand 10 contain all pneumatic valves and regulators to control the operation of the pneumatic cylinder 11. Before this operation a filled aseptic bottle 14 has been closed by a resilient plug and a metal cap 15 whereafter it has been positioned, either manually or via automatic means axially below the cylinder 11.

Figure 1:
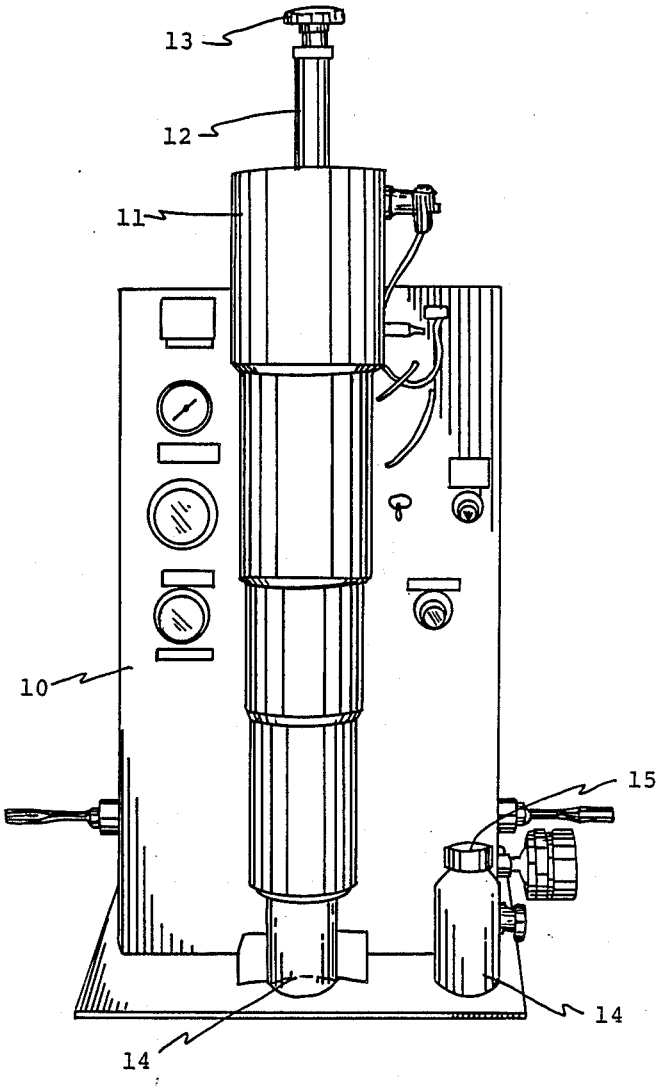
FIG. 1 is a perspective view of the bottle sealing machine according to the invention.

The cylinder 11 comprises a piston 16 which is movable within the cylinder chamber 17 and has a central piston rod 18. The rod 18 reaches downwards into a tubular guide bushing 19 which is bolted via bolts 20 to the end wall **11*a* of the cylinder 11. The bushing has longitudinal slits 19*a* through which a tranverse carrier pin 21 at the end of the rod 18 reaches. On this pin 21 is fixed, via screws 22, a clamping sleeve 23 which is protected by a tubular housing 24 fixed on the cylinder 11, and which holds a tubular guide holder 25. This guide holder 25 can move telescopically within the housing 24 together with the clamping sleeve 23 and the rod 18. A guide bushing 26 can move between the holder 25 and the clamping sleeve 23 against the action of a resilient spring 27**.

Within the guide bushing 19 is an extension tube 28 telescopically journalled with radial slits **28*a* for the carrier pin 21. The movement of the extension tube 28 within the guide bushing 19 is limited by an end collar 19*b*. The lower end of the extension tube 28 carries shaft pins 29 on which clamp jaws 29*a* are pivotably journalled, so that their lower ends can swing radially between an inner and an outer diameter. A pressure tube 30 can slide axially within the extension tube 28 and its stroke is limited by the carrier pin 21, which passes through longitudinal slits 30*a* in said pressure tube and a transverse faucet 31 in the extension tube 28, which passes through other slits 30*b* in said pressure tube. A plunger 32 can slide axially within the pressure tube 30 and it is pressed downwards by means of a resilient spring 33. Another spring 34 acts between a flange 23*a* on the clamping sleeve 23 and the extension tube 28 so that it tends to push the extension tube downwards in relation to the clamping sleeve 23. Yet another spring 35 acts between a flange 30*c* on the pressure tube 30 and the end of the extension tube 28 to lift said pressure tube in relation to the extension tube 28**.

Figure 2:
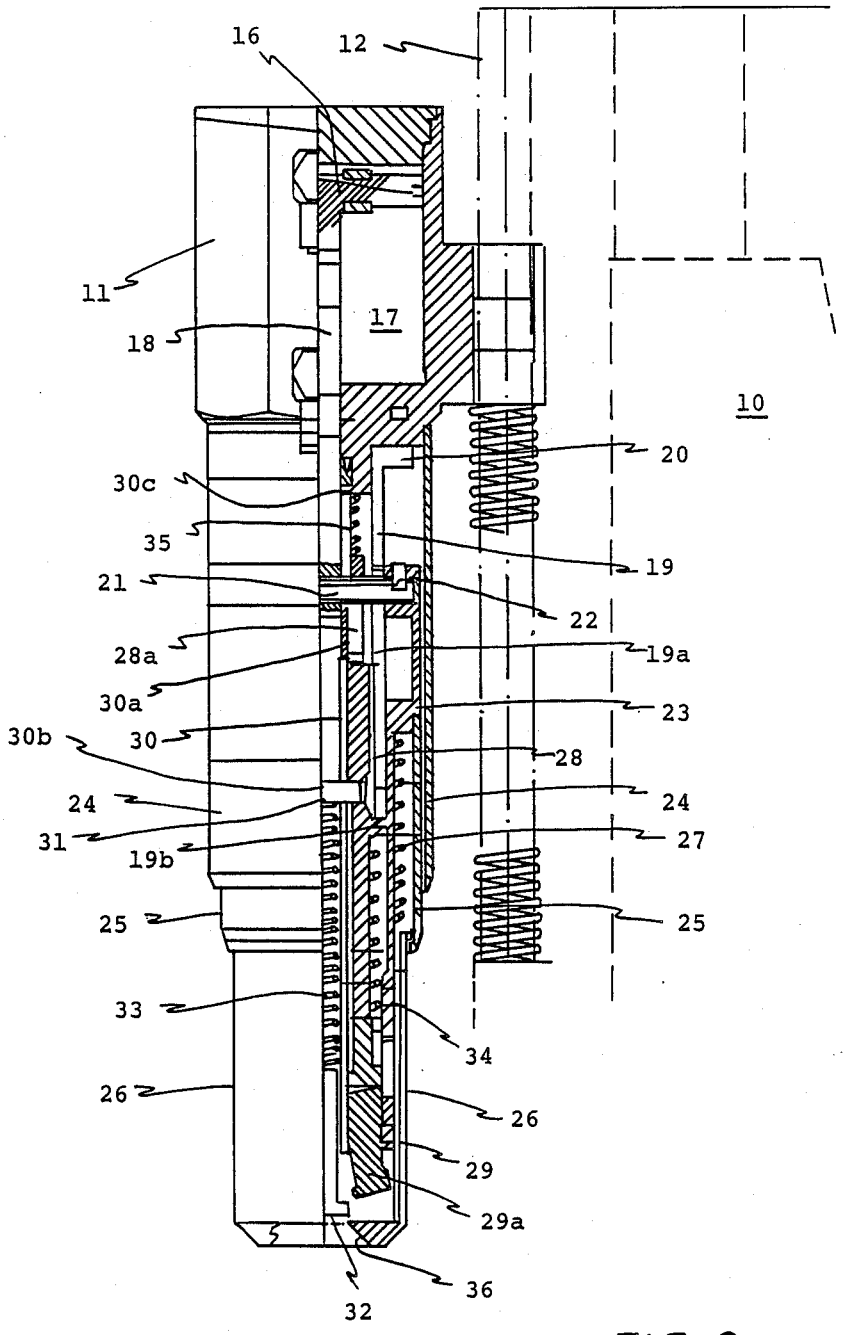
FIGS. 2 and 3 are partly sectioned side views showing the machine before and during the sealing of a cap.
Figure 3:
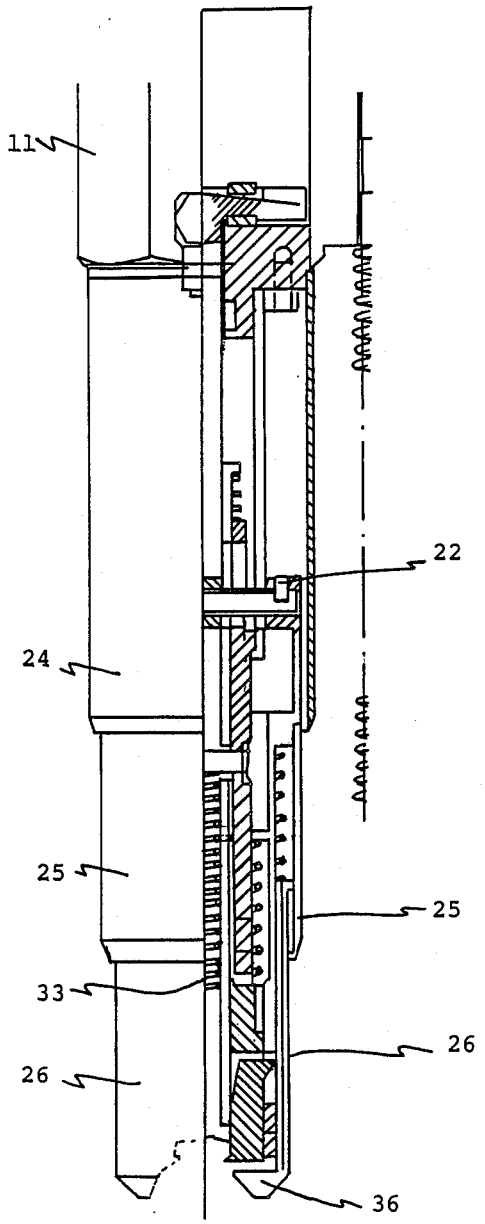
Figure 4:
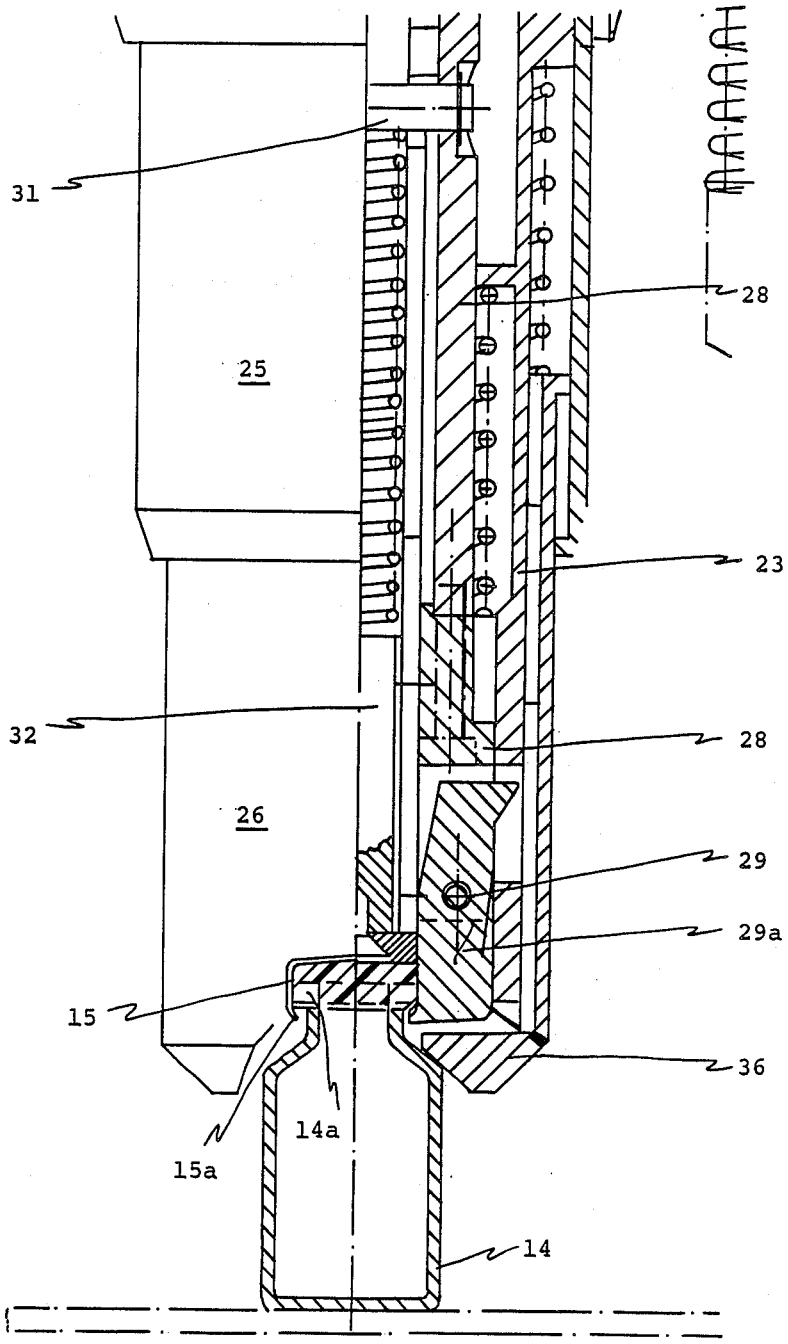
FIGS. 4 and 5 show in larger scale the neck of a bottle before and after completion of the sealing.
Figure 5:
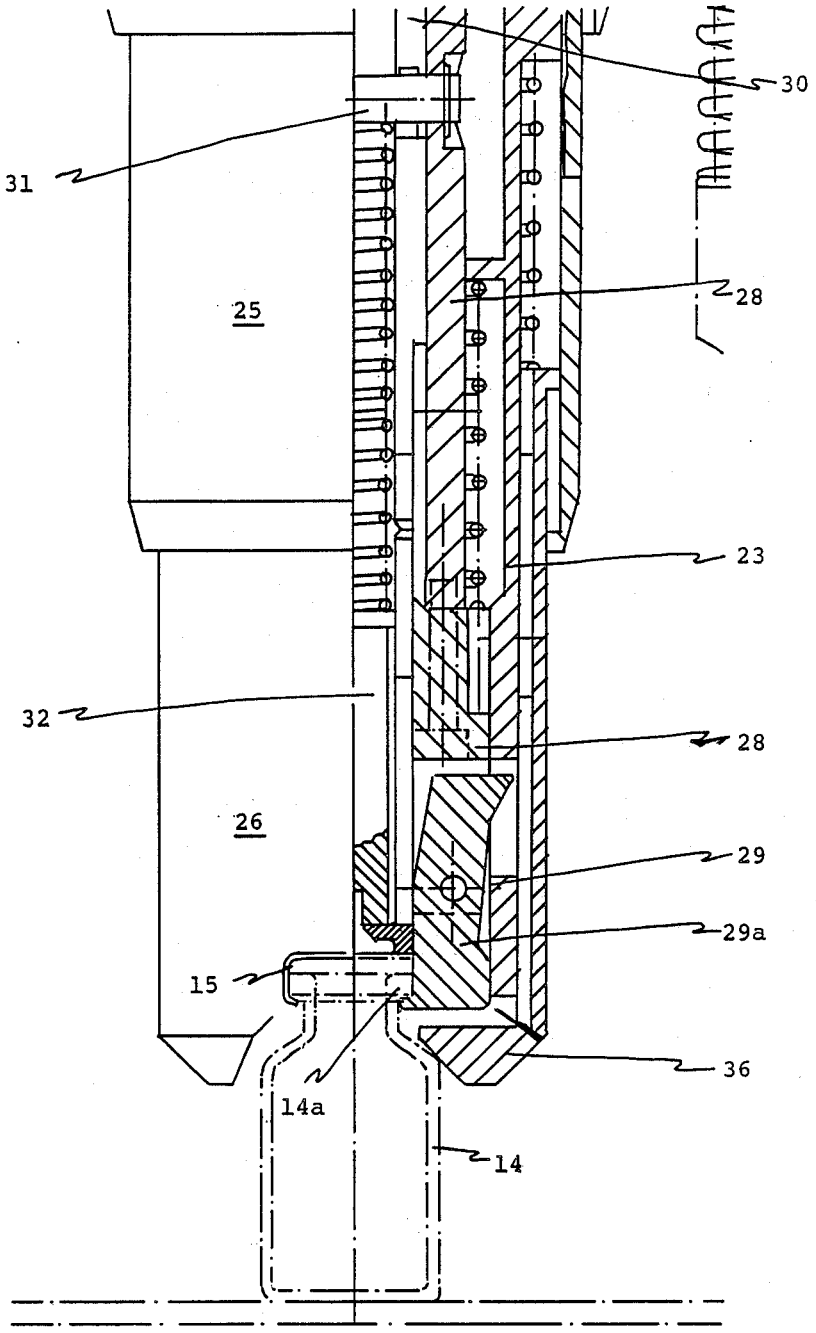

The machine works in the following way: After a bottle 14 has been placed below the cylinder 11 it can be activated, wherein the piston 16 starts to move downwards from the position in FIG. 2. First the guide bushing 26 touches the top of the bottle 14. This bushing has a conical opening 36 which acts to center the bottle in relation with the longitudinal axis of the cylinder 11. If the bottle is badly positioned below the cylinder the guide bushing 26 will be pressed all the way into its recess between the clamping sleeve 23 and the guide holder 25 during the downward stroke of the piston 16. If this happens a relief valve not shown in the drawings, will be opened and the movement of the piston 16 will stopped until the bottle (or any other object) is removed.

If the bottle is positioned within acceptable limit (e.g. circa 0–5 mm away from the longitudinal axis of the cylinder) the neck of the bottle will pass through the opening 36. Then the plunger 32 will abut the cap 15 and slide into the pressure tube 30 until it abuts the lower end of said tube. The pressure tube 30 is now prevented from moving downwards together with the rest of the moving mechanism. But as soon as the extension tube 28 reaches the end of its stroke which is limited by the faucet 31 in the slits 30*b*, it is also prevented to move with the rest of the mechanism. The clamping sleeve 23 which is rigidly connected to the piston rod 18 will now slide downwards along the extension tube 28 whereupon the clamping sleeve end will press the clamp jaws 29*a* radially inwards until they together form a die tool around the neck of the bottle and below the skirt of its cap 15. Finally the end of the piston rod 18 abuts the pressure tube 30 to press it downwards, so that the plunger 32 will press the cap downwards into the die tool against the action of the resilient plug 37, wherein the skirt 15*a* of the cap 15 will yield and flow radially inwards below the annular bead 14*a* at the mouth of the bottle 14, and the sealing of the bottle is completed.

This above described sealing process is initiated by the contact of the plunger 32 with the top of the bottle 14. It is therefore not necessary to make careful adjustments of the cylinder stroke, because the bottle defines the action of the cylinder mechanism.

When the sealing of the bottle is finished, the piston movement is reversed and the clamping sleeve 23 moves upwards, opening the jaws 29*a* radially wherein their upper ends can swing radially into and out of apertures 23*b* in a circumferential clamping sleeve 23. The carrier pin 21 then abuts the upper ends of the slits 28*a* and 30*a* in the extension tube 28 and the pressure tube 30, respectively and these will be pulled upwards together with the piston 16, while the plunger ensures that the bottle remains in position until the cylinder has returned to its initial position.

This invention is not limited to the specific details shown and described and departures may be made from such details without departing from the principles of the invention and without sacrificing its chief advantages.

What we claim:

1. A machine for automatic sealing of sterile bottles in a bottle filling plant, said bottles having an annular bead at the mouth of said bottle, a resilient plug in the mouth of each bottle, and a metal cap over said bead and plug, said bottle being positioned below said machine, said machine comprising, fluid powered means to axially displace a die forming means between an upper end position above said bottle and a lower end position surrounding said cap;

telescopically displaceable means to close said die forming means when in said lower end position radially around the neck of said bottle and, after execution of said sealing, to open said die forming means radially and return it to its upper end position; and telescopically displaceable plunger means to apply axial pressure towards the top of said cap pressing it down into the die forming tool against the action of said resilient plug.

2. A machine according to claim 1, wherein said die forming means comprise individually pivotable jaws.

3. A machine according to claim 2, wherein said telescopically displaceable closing and opening means comprise a coaxial tube encompassing said jaws and having apertures which upper portions of the jaws may enter when said means is moved downwards to its closing position.

4. A machine according to claim 3, wherein the jaws are shaped with an upper and a lower limb which are joined at an angle at their pivot point, said angle diverging radially outwards.

5. A machine according to claim 1, wherein the telescopically displaceable plunger means is actuated by the proper placement of the bottle, and said plunger means abuts the bottle cap and slides into a pressure tube until it abuts the lower end of the pressure tube.

6. A machine according to claim 5, wherein said telescopically displaceable opening and closing means is actuated after said telescopically displaceable plunger means abuts said cap and slides into the pressure tube.

7. A machine according to claim 6, wherein the telescopically displaceable opening and closing means press the die forming means radially inwardly until they form a die tool around the neck of the bottle.

8. The machine according to claim 7, wherein the movement of a piston rod abuts the pressure tube to press the pressure tube downwardly, so that the telescopically displaceable plunger means press the cap downward in response to the telescopically displaceable opening and closing means pressing the die forming means radially inward.

9. A machine according to claim 6, wherein the telescopically displaceable means comprises a clamping sleeve and a coaxial tube.

10. A machine according to claim 7, wherein the coaxial tube is actuated before the clamping sleeve.

11. A machine according to claim 10, wherein the clamping sleeve is actuated after the coaxial tube has reached the end of its stroke.

12. A machine according to claim 9, wherein the clamping sleeve is rigidly connected to a piston rod.

* * * * *